US005460368A

United States Patent [19]

Pearson

[11] Patent Number: 5,460,368

[45] Date of Patent: Oct. 24, 1995

[54] LIGHTWEIGHT BOUNCEABLE THROWING DEVICE PROVIDING SLOW ERRATIC FLIGHT

[76] Inventor: Kent Pearson, 785 Camino del Sur, Apt. 1, Goleta, Calif. 93117

[21] Appl. No.: 335,243

[22] Filed: Nov. 7, 1994

[51] Int. Cl.[6] ..... A63B 43/02

[52] U.S. Cl. ..... 273/65 EE; 273/65 EG; 273/65 EF

[58] Field of Search ..... 273/58 R, 58 A, 273/58 B, 58 D, 58 K, 65 R, 65 E, 65 EF, 65 EG, 65 ED, 65 EE, DIG. 20

[56] References Cited

U.S. PATENT DOCUMENTS

| | | | |
|---|---|---|---|
| 2,194,674 | 3/9140 | Riddell | 273/65 EF |
| 3,884,466 | 5/1975 | MacDonald et al. | 273/65 EE |
| 4,003,574 | 1/1977 | MacDonald et al. | 273/65 EF |
| 4,219,959 | 9/1980 | Fleischer | 273/58 D |
| 4,736,948 | 4/1988 | Thomas | 273/65 EF |
| 4,887,814 | 12/1989 | Winter | 273/65 EF |
| 5,000,451 | 3/1991 | MacDonald et al. | 273/65 EF |
| 5,033,743 | 7/1991 | Wright | 273/58 K |
| 5,133,550 | 7/1992 | Handy | 273/65 EF |
| 5,280,906 | 1/1994 | Vitale | 273/58 K |

*Primary Examiner*—V. Millin
*Assistant Examiner*—Steven B. Wong
*Attorney, Agent, or Firm*—Ashen, Golant & Lippman

[57] ABSTRACT

A play device for being thrown generally like a football. The device has a tubular body that has a generally barrel-like external shape and a large central through-passageway. Its shape, light weight and central passageway combine to provide relative slow, soaring and irregular flight characteristics, making its path somewhat erratic and the device often a challenge to catch. It is made of a lightweight but shape-retaining, tough, resilient material such as polyethylene that will bounce harmlessly off walls or a person it may engage. The device may be formed with one or more openings through its wall such as a continuous or intermittent spiral groove that extends from end to end.

18 Claims, 4 Drawing Sheets

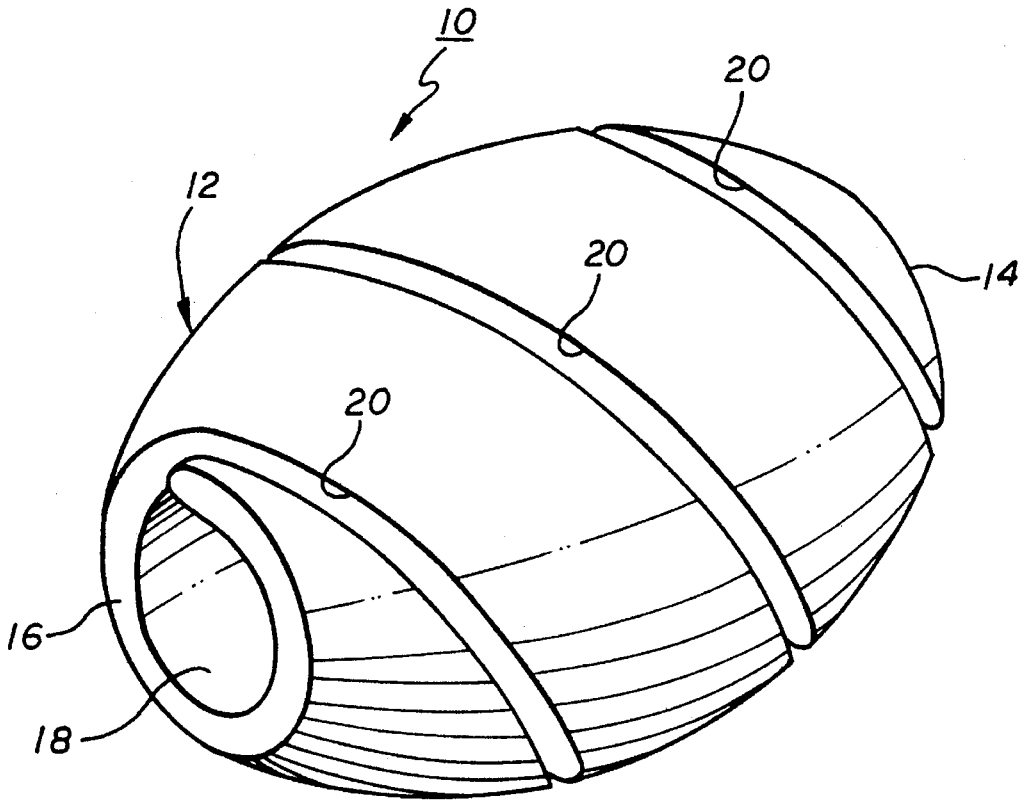
FIG. 1
FIG. 2
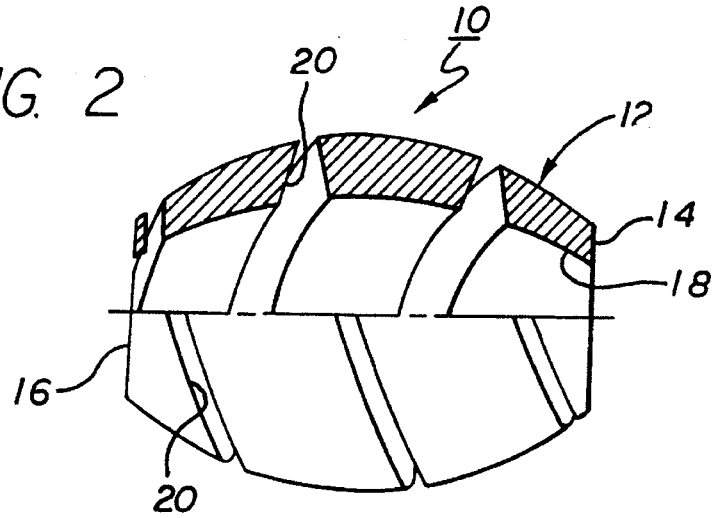

FIG. 6
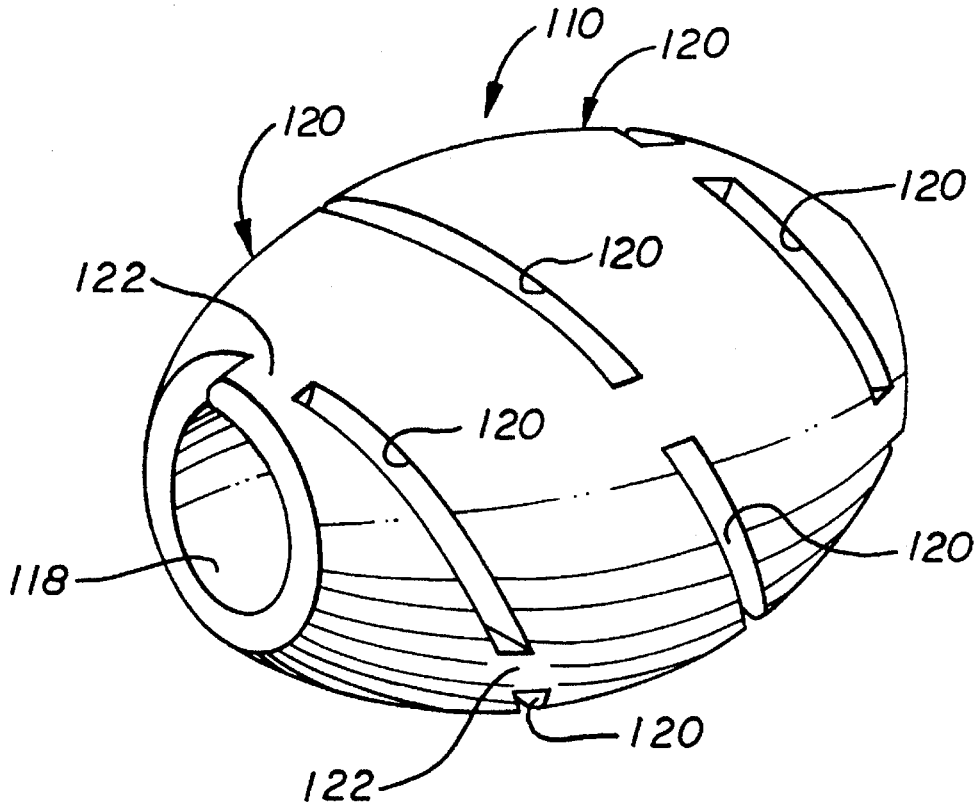
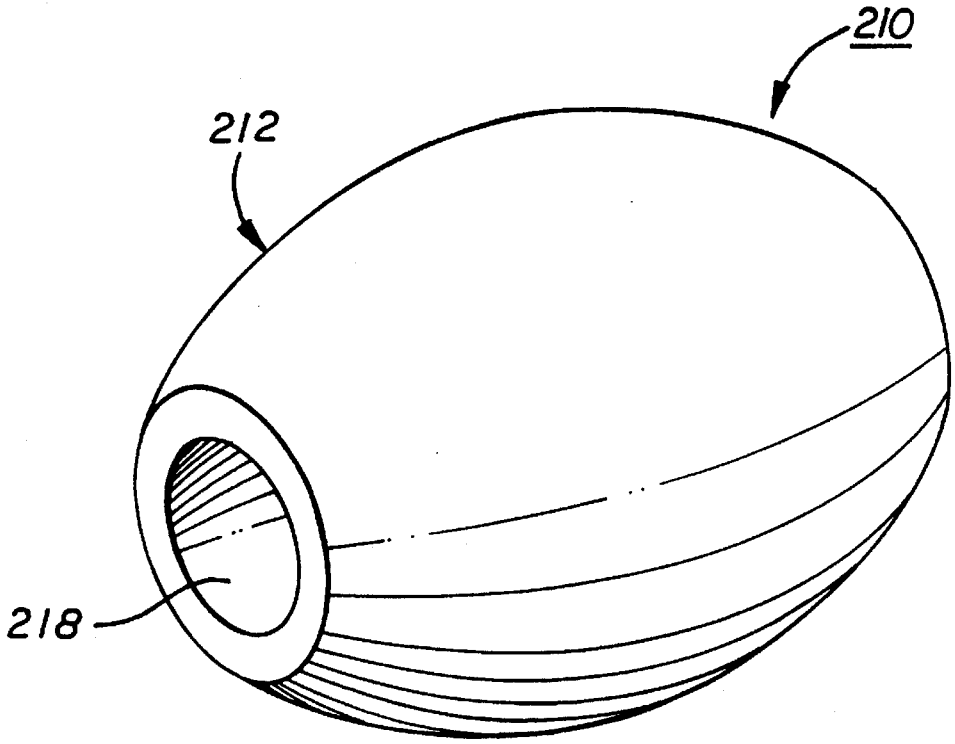
FIG. 7

FIG. 8
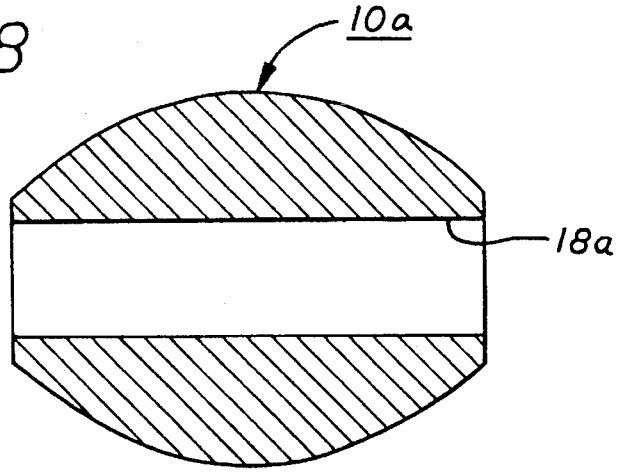
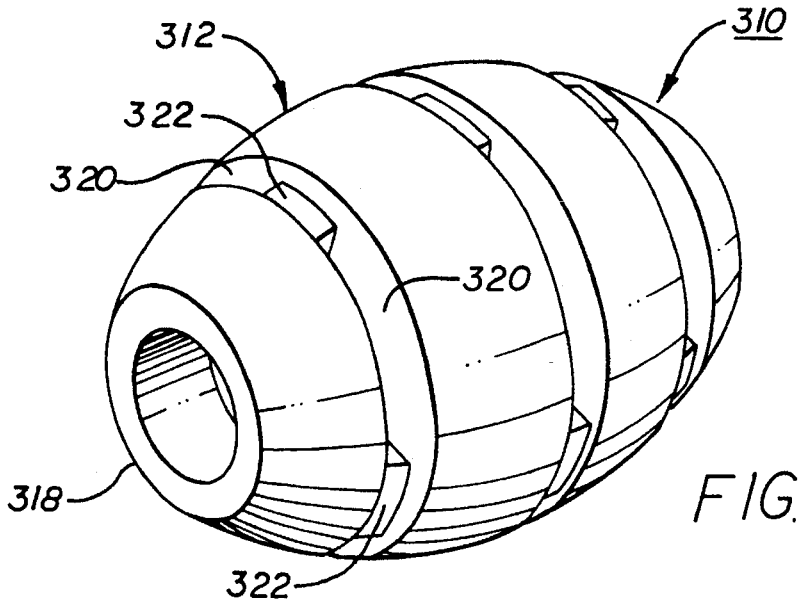
FIG. 9
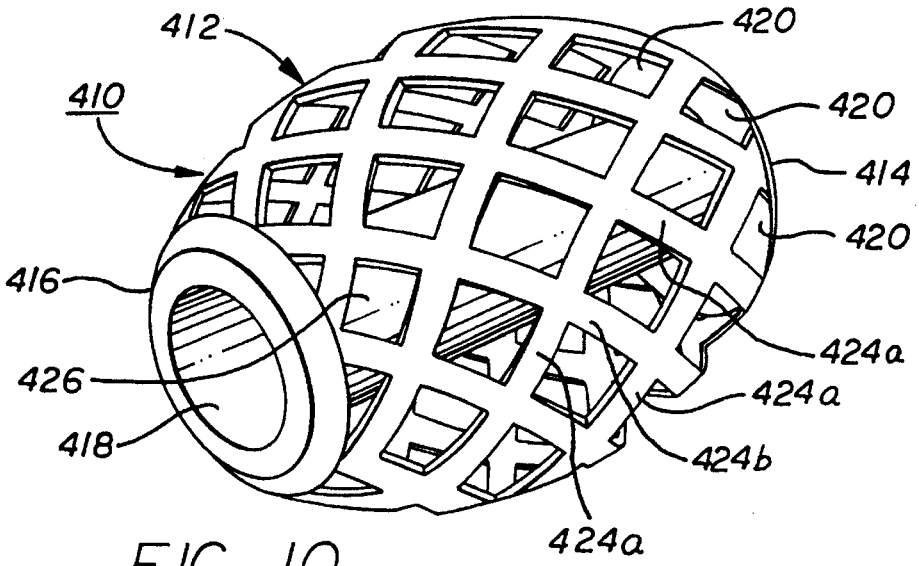
FIG. 10

LIGHTWEIGHT BOUNCEABLE THROWING DEVICE PROVIDING SLOW ERRATIC FLIGHT

FIELD OF INVENTION

Throwable play devices that have erratic flight patterns.

BACKGROUND OF THE INVENTION

There have been countless play devices for being thrown, as between two or more players or toward a target. The construction of such a play device can determine a variety of things about its use and usefulness such as: the ease or difficulty of throwing it, controlling its direction, trajectory, distance, flight characteristics, speed, aerodynamic qualities, danger to things it may engage, etc.

There are also many variables relating to its design and productions such as the cost of materials and fabricating methods, ease of production, durability, and resistance to being broken or rendered inoperative (or less effective).

Such devices are often designed for true, accurate patterns of flight and ease of being caught. Play with such devices can quickly become the same and repetitious.

SUMMARY OF DISCLOSURE

The illustrated play device has a lightweight, shape-retaining, generally tubular resilient body designed to be thrown generally like a football, i.e., generally rotating or spiraling about its axis as it flies forwardly. It may be generally externally barrel-shaped and proportioned to be easily held in one hand. The tubular body defines a large central through-passageway from end to end which, combined with its shape and light weight, provides, a relatively slow, soaring, random or erratic flight path. It is fun to watch and difficult to catch, all providing added play value. The resilient lightweight body will harmlessly bounce off walls, objects or persons that it hits.

The device may be provided with one or more openings or cutout portions that extend through the body into the passageway. In one form it has a continuous spiral cut or groove from end to end. In other forms the cutouts are arranged in various configurations such as defining an intermittent spiral. In yet another form the body may be solid with no cutout portions. The illustrated device is preferably made of a material such as polyethylene that is also tough and resistant to cracking, breaking or permanent deformation.

IN THE DRAWINGS

FIG. 1 is a perspective view of a throwable device embodying a one form of the invention.

FIG. 2 is a side view of the device, with the top half partially cut-away to show the interior construction.

FIG. 6 is a perspective view of the presently preferred form of throwable device.

FIG. 7 is a perspective view of another form of the device.

FIG. 8 is a schematic side view of another form of the device with the top half cut-away to reveal the interior configuration.

FIGS. 9 and 10 are schematic perspective views of devices having other arrangements of cutout portions.

DETAILED DESCRIPTION OF THE DRAWINGS

Figure 3:
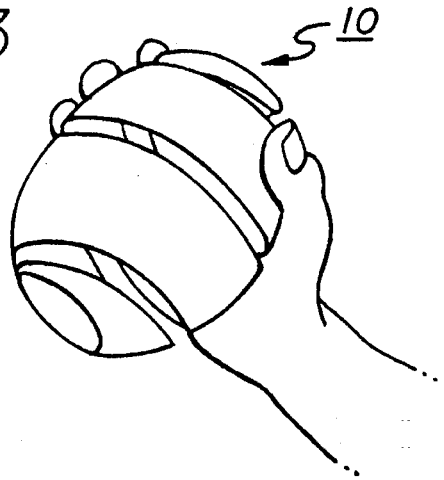
FIG. 3 is a schematic perspective view of the device held in the hand of a user.

FIGS. 1 and 2 illustrated a throwable device 10 which embodies one form of the invention.

The device 10 has an elongated tubular body or wall 12 which is generally barrel-shaped externally, having generally flattened front and rear ends 14, 16. The body 12 has a smoothly curved outer configuration or shape that is circular in transverse cross-section. It is largest in diameter at its center and becomes progressively smaller in diameter toward each end 14, 16. The body 12 thus provides an intermediate holding portion between the ends 14, 16.

As shown in FIG. 2, the body 12 has a generally uniform wall thickness, which produces a large elongated barrel-shaped central passageway 18 that extends uninterrupted from end to end of the body. In the illustrated device 10 the wall 12 is somewhat thicker at the center than at its ends. The cross-section of the passageway 18 extends over a major portion of the cross-section of the device 10.

Figure 4:
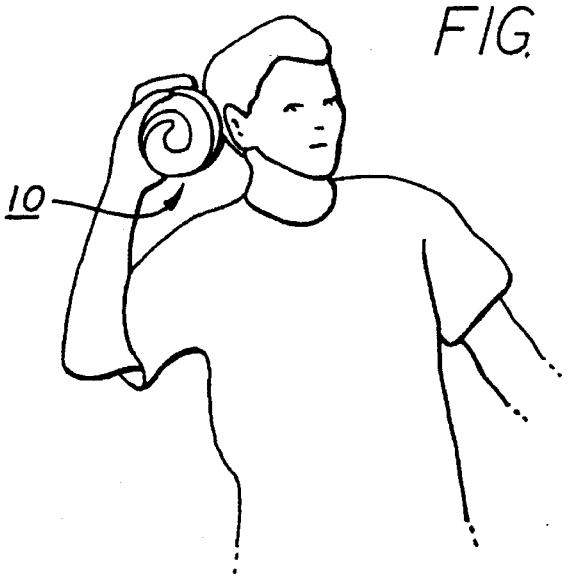
FIG. 4 is a schematic illustration of the user with his arm cocked and about to throw the device.
Figure 5:
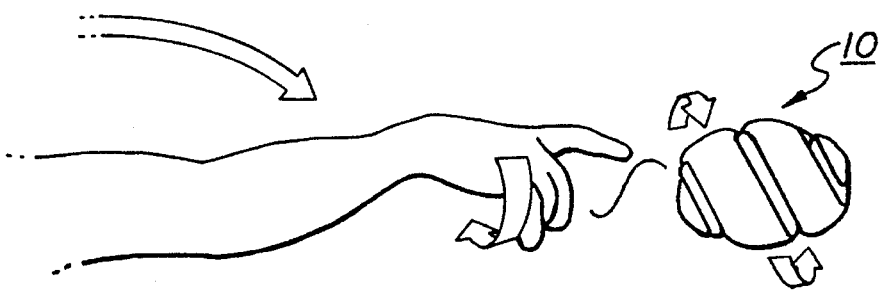
FIG. 5 is a schematic illustration of the user's arm and hand as the device is thrown.

When the device 10 is thrown as illustrated in FIGS. 3–5, it may be caused to spin or rotate about it longitudinal axis as shown by the arrow in FIG. 5. The air flowing through the passageway 18 alters the flight characteristics of the device 10, tending to cause it to soar and fly in somewhat random and unpredictable ways. This makes catching it more of a challenge and adds play value.

The device 10 is preferably made of a lightweight, shape-retaining, resilient material. This allows the device 10, even when thrown with great force, to travel at only moderate speeds and to be generally harmless to persons and objects it may encounter. The flattened front end 14 avoids that shape point of a device having the actual shape of a football. The lightweight resilient material will bounce off rather than do harm. This also adds play value.

In the illustrated device 10, the body 12 is formed with a continuous spiral cut or groove 20 that winds from end to end. It is desirable that the device be made of a relatively tough material so that the device will maintain its basic shape over time and will withstand the impacts and stress of repeated flights and contact with other objects.

A working prototype like device 10 with the following specifications has been found to be very effective and durable: an external diameter of about 65 mm at each end and about 125 mm at the center; passageway diameter of about 40 mm at each end and about 80 mm at the center; a length of about 165 mm; a wall thickness of about 12 mm at the ends and slightly more toward the center; and a continuous spiral groove or cut with a width of about 6 mm. Such a device 10 is shown easily held and thrown in FIGS. 3–5.

The prototype device is molded of lightweight resilient but tough plastic material: polyurethane (injected self-skinning with a blowing agent). It has a weight of about 12 oz.

Other similar materials might be utilized such as polyethylene or latex foam (closed cell).

The device may be made in other sizes, such as approximately the size of a football or in miniature size as could go on a key chain. The length could be from about 70 mm to about 190 mm. The cross-section could be from about 20 mm to about 80 mm at the ends, and from about 50 mm to about 150 mm at the center.

The central passageway 18 could be modified in shape as for example to a cylindrical configuration 18*a* as shown in FIG. 8. This would provide more lift and irregularity to the flight, but would add material and weight.

The cutout portions or openings could also be provided by other than a continuous spiral groove. Such other configurations would also provide the desired lessening of weight and saving of materials. They would also contribute in different ways to airflow patterns and turbulence around the throwing device, resulting in different erratic motions.

In this connection, FIG. 6 illustrates the presently preferred form of throwable device 110. The device 110 has the same general or overall configuration as device 10 except that the cutout portions are not in the form of the continuous spiral groove 20 but are a series of separated lengths or segments 120 along a spiral path. This arrangement could be seen as a spiral interrupted by support beams or spanning portions 122 located at spaced intervals along its length. This preferred embodiment 110 is stronger and more resistant to damage than device 10. It also is less collapsible on impact then device 10, and will bounce or rebound higher.

FIG. 7 illustrates another alternative form of throwable device 210. The device 210 has the same general overall configuration as devices 10 and 110 except that it is solid and does not have any cutout portions.

FIGS. 9 and 10 illustrate two other forms of throwable device 310 and 410, each having a plurality of differently arranged cutouts 320, 420.

In illustrated device 310, the cutout portions 320 are arranged in groups or sets that extend circumferentially around the body 312 at longitudinally spaced intervals therealong. Each group of cutout portion portions 320 is an intermittent part of a circle, separated from adjacent cutout portions in the set by a support beam or spanning portion 322.

In illustrated device 410 there is an open matrix pattern, the cutout portions 420 are small square or rectangular openings defined by a lattice work structure. The lattice work structure is comprised of two sets of spaced-apart spirally extending strips 424*a*, 424*b*, each set running in the generally opposite direction. There are also circular end rings at the front and rear ends 414, 416 of the device 410. A solid central cylindrical tube 426 defines a large central through passageway 418.

Various modifications and changes may be made in the illustrated apparatus without departing from the spirit and scope of the invention as set forth in the following claims.

What is claimed is:

1. A lightweight play device for being held by a player in one hand and thrown generally like a football, the device comprises:

a body made of a relatively lightweight, shape-retaining, resilient material, the body being elongated, and generally tubular with a barrel-shaped exterior, the body having an intermediate holding portion, a generally flattened forward end, and a generally flattened rearward end, the body having a large longitudinal through-passageway extending from end to end of the body to provide added lift and unpredictability to the flight of the thrown device, said tubular body being formed with at least one cutout portion extending completely through the body from its exterior into the passageway so that air may flow through such cutout portion.

2. The play device of claim 1 wherein said cutout portion is in the form of a spiral groove that extends generally the length of the body.

3. The play device of claim 2 wherein the groove is uninterrupted and continuous from end-to-end of the body.

4. The play device of claim 2 wherein the spiral groove is interrupted at spaced intervals therealong by support portions.

5. The play device of claim 1 wherein there are a plurality of separate, spaced apart cutout portions.

6. The play device of claim 5 wherein said cutout portions are arranged along circumferential rings spaced longitudinally along the body.

7. The play device of claim 5 wherein said cutout portions are arranged in an open matrix pattern that extends over at least a major portion of the body.

8. The play device of claim 1 wherein the body is formed of a single piece of material.

9. The play device of claim 8 wherein the body is a molded part.

10. The play device of claim 1 wherein the body is made of a tough, resilient, lightweight plastic material.

11. The play device of claim 10 wherein the body is made of polyethylene.

12. The play device of claim 10 wherein the body is made of closed cell latex foam.

13. The play device of claim 1 wherein said body has a length of about 165 mm and a cross-section about midway between its ends of about 125 mm.

14. The play device of claim 1 wherein said body has a length of from about 70 mm to about 190 mm and a maximum cross-section of from about 50 mm to about 150 mm about midway between its ends.

15. The play device of claim 1 wherein the contour of the passageway approximates the exterior contour of the body.

16. The play device of claim 1 wherein the passageway is generally cylindrical.

17. The play device of claim 1 wherein the passageway has a cross-section that occupies a major portion of the cross-section of the device.

18. A play device for being thrown generally like a football, the device comprising an elongated generally tubular body made of a single piece of lightweight, shape-retaining, resilient molded plastic, the body having the external shape generally like that of a barrel, the body having an intermediate holding portion, and a pair of generally flattened ends, the body also having a large central through-passageway that extends from end to end of the body to add lift and unpredictability to the flight of the thrown device, the body including one or more cutout portions that extend completely through the body and into the passageway so that air can flow through such cutout portions.

* * * * *